US006450883B1

(12) United States Patent
O'Halloran

(10) Patent No.: US 6,450,883 B1
(45) Date of Patent: Sep. 17, 2002

(54) OPERATION OF GAMING MACHINES

(75) Inventor: Terence Matthew O'Halloran, Edgecliff (AU)

(73) Assignee: I.G.T. (Australia) Pty Limited, New South Wales (AU)

( * ) Notice: Subject to any disclaimer, the term of this patent is extended or adjusted under 35 U.S.C. 154(b) by 0 days.

(21) Appl. No.: 09/586,373

(22) Filed: Jun. 2, 2000

(30) Foreign Application Priority Data

Feb. 6, 1999 (AU) ..... PQ0706/99

(51) Int. Cl.[7] ..... A63F 1/00

(52) U.S. Cl. ..... 463/16; 463/13; 463/17; 463/18; 463/19; 463/20; 463/21; 273/138.1; 273/139; 273/143

(58) Field of Search ..... 463/16–21, 13; 273/143 R, 138.1, 139

(56) References Cited

U.S. PATENT DOCUMENTS 4,198,052 A * 4/1980 Gauselmann ..... 273/143 R
5,205,555 A * 4/1993 Hamano ..... 273/143 R
5,807,172 A * 9/1998 Piechowiak ..... 463/20
5,976,016 A * 11/1999 Moody et al. ..... 463/13
5,980,384 A * 11/1999 Barrie ..... 463/16
6,004,207 A * 12/1999 Wilson, Jr. et al. ..... 463/20
6,093,102 A * 7/2000 Bennett ..... 463/20
6,113,098 A * 9/2000 Adams ..... 273/143 R
6,126,542 A * 10/2000 Fier ..... 463/16
6,149,521 A * 11/2000 Sanduski ..... 463/13
6,186,894 B1 * 2/2001 Mayeroff ..... 463/20
6,190,254 B1 * 2/2001 Bennett ..... 463/13
6,241,607 B1 * 6/2001 Payne et al. ..... 463/20

* cited by examiner

*Primary Examiner*—Valencia Martin-Wallace
*Assistant Examiner*—Yveste G Cherubin
(74) *Attorney, Agent, or Firm*—George H. Gerstman; Seyfarth Shaw

(57) ABSTRACT

A gaming machine offers a first base game to a player, in the nature of a spinning reel game. Three spinning reels spin in accordance with each play of the game. On the occurrence of certain winning combinations, constituting a triggering event, a bonus game is entered. In the bonus game three rows, respectively of two, three, and four playing cards, are arranged face down. A player is required to select one of the rows and then choose one card from that row, seeking to choose a winning card, such as a Joker. The respective odds of winning between three lines of cards are unique integer multiples of each other.

25 Claims, 4 Drawing Sheets

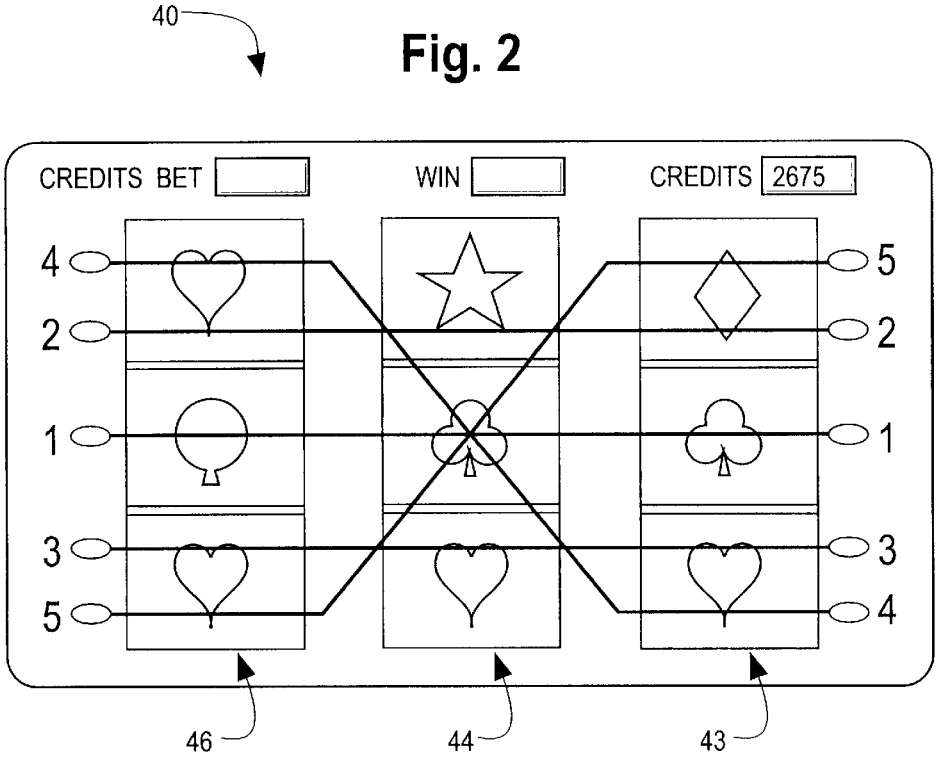
Fig. 2
Fig. 3
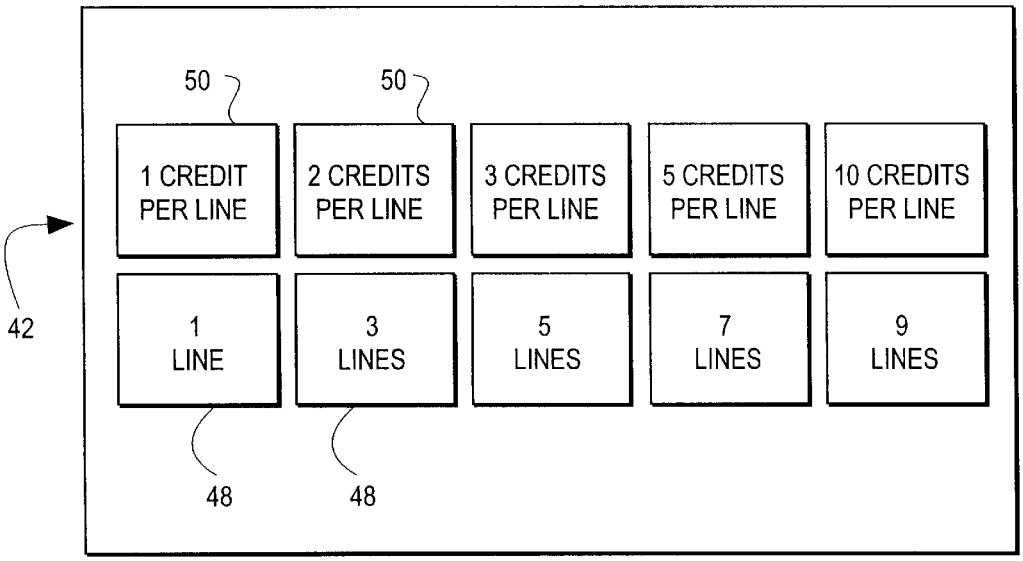

OPERATION OF GAMING MACHINES

BACKGROUND OF THE INVENTION

Video gaming machines also are commonly known as slot, poker or fruit machines, and provide a player with a game of chance. Money is inserted in a gaming machine, or electronically transferred, to purchase "credits" on the machine. The credits are then used to wager against games played, and all winnings and losses occur in credit value.

Traditional games played on gaming machines include spinning reel games, where various combinations of indicia appearing on simulated spinning reels across one or more win lines result in credits being awarded and added to the player's credit total. Other gaming machines offer card games, such as draw poker or blackjack. Common to both forms of games is a secondary or bonus game feature, whereby, on any winning game of the primary or base game, a bonus mode is entered. In the bonus mode the winnings from the first game can be wagered, typically in a "double up" scenario, viz., the winnings can be doubled or lost. Such "double up"game features typically involve a binary choice, such as selecting whether a "face down" card is of a red or black suit. In other forms, a "beat the dealer" feature can be provided where a player is dealt a card, then must choose one card from four "face down" cards that beats the revealed dealt card on face value. "Double up" features have proved very popular with players of gaming machines.

In many gaming establishments, it is almost always the case that there will be a number of gaming machines provided by different vendors, and it is a particular motivation of vendors for their gaming machines to be played over others. This is relevant to both the income derived from the lease of the machines to the licensed premises and in seeking to ensure ongoing business with the licensed premises. It is thus a very real motivation for vendors to provide new and commercially useful game functions to attract players to their particular machines within any given licensed premises.

SUMMARY OF THE INVENTION

It is an object of the present invention to provide a game bonus feature that gives a player greater variety of choice and enjoyment in playing gaming machines having bonus game features.

Accordingly, the present invention provides a method for operation of a gaming machine, comprising the steps of:

providing a first game; and

On occurrence of a triggering event in a play of said first game, entering a second bonus game in which a common game type with two or more game choices is provided, said game choices having respective odds of winning that are unique integer multiples, specifically odds that are inversely proportional to the number of possible selections within the respective game choice.

The invention further discloses a gaming machine comprising: a display by which game play is displayed to a player; player input controls for player interaction in game play; and A programmed controller, having control over game play and operation and operable to provide a first game, and on occurrence of a triggering event in play of the first game to enter a second bonus game in which a common game type with two or more game choices is provided, said game choices having respective odds of winning that are inversely proportional to the number of possible selections within the respective game choice.

Once a game choice is made, a further individual choice is made by the player upon which the outcome of the bonus game is determined.

In a preferred embodiment, the choices are displayed to a player graphically in a manner to indicate the ascending or descending odds. In one form, the choices can be as lines of face down cards to be revealed, to be arranged as a pyramid. The lines can have one common winning card amongst them.

The invention further discloses a method for operation of a gaming machine, comprising the steps of:

providing a spinning reel game of chance; and on occurrence of a triggering event in a play of said spinning reel game, entering a bonus card game including the further steps of:

(i) displaying at least two rows of face-down cards;

(ii) a player selecting a row and choosing a card within that row, and wherein the respective odds of choosing a winning card are 1/n, where n is the number of possible selections within each game choice, and n is a unique value for each said choice, specifically including a prize having a value that is proportional to the number of possible selections within the respective game choice.

Practice of the present invention is commercially advantageous in that there will be increased interest and enjoyment by players of gaming machines, increased sales of machines by vendors and increased revenues for the operators of licensed premises and taxing authorities such as governments.

BRIEF DESCRIPTION OF THE DRAWINGS

FIG. 2 shows a representative screen display illustrating normal base game play;

FIG. 3 shows representative player pushbuttons;

DETAILED DESCRIPTION

Figure 1:
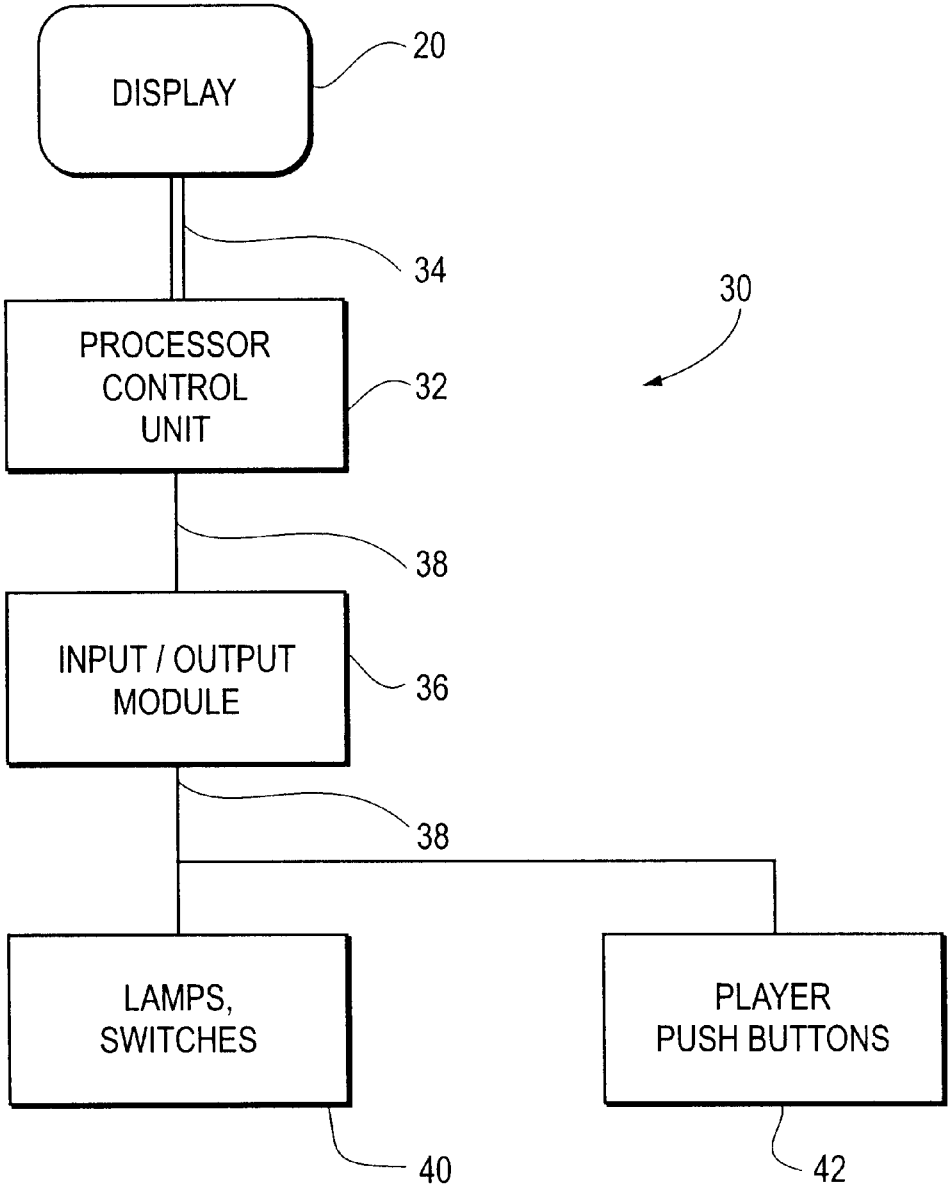
FIG. 1 shows a schematic block diagram of a video gaming machine.

FIG. 1 is a schematic block diagram showing the basic component parts of a known video gaming machine 30, in which the video display 20 is connected with a processor control unit 32 by a video interface link 34. The control unit 32 contains resident software that has control over all of the operations of the gaming machine 30, including play of the game and simulation of the spinning reels on the display 20. The control unit 32 also is coupled with an input/output module 36 by an internal bus 38. The input/output module 36, in turn, connects by the bus 38 to lamps and switches 40 associated with the gaming machine, and to player pushbuttons or controls 42 by which a player can wager desired credit units, select the number of win lines per play of the game and activate play of the game. A known gaming machine upon which software embodying the invention can be run includes the present applicant's Game King™ type gaming machine. Software embodying the invention resides in the EPROM memory within the processor control unit 32 and is written in the "C" or "assembler" programming languages. Those skilled in the art would be able to implement an embodiment of the invention in software, as a matter of routine.

FIG. 2 shows a representation of the screen display 40 of a video gaming machine, offering a "base" or "primary" game to a player. Each of three simulated (video) reels 43, 44, 46 spin in play of the game with a resulting combinations of indicia occurring on any one of the (in this case) five "win lines" 1–5, chosen by the player with buttons 48, determining the outcome of the game. As is well known, a player feeds a number of coins into the gaming machine to provide credits upon which to play the base game.

FIG. 3 illustrates the player pushbuttons 42 according to one embodiment of the present invention. The player pushbuttons 42 for controlling game play include a lower row of win line selection buttons 48 and an upper row of bet buttons 50 by which a player can wager 1, 2, 3, 5 or 10 credits per line per play.

For any play of the base game there will be a resulting combination of symbols appearing on the three reels and, thus, on the selected number of win lines. If there is a winning combination on any of the win lines, then the supplemental or bonus game feature is entered. This is one example of a "triggering event."

FIG. 3 shows a screen display 40' similar to that of FIG. 2, but in this case of a touch screen type, meaning that the separate player controls 42 (shown in FIG. 3) are incorporated into the display 40'.

Figure 4:
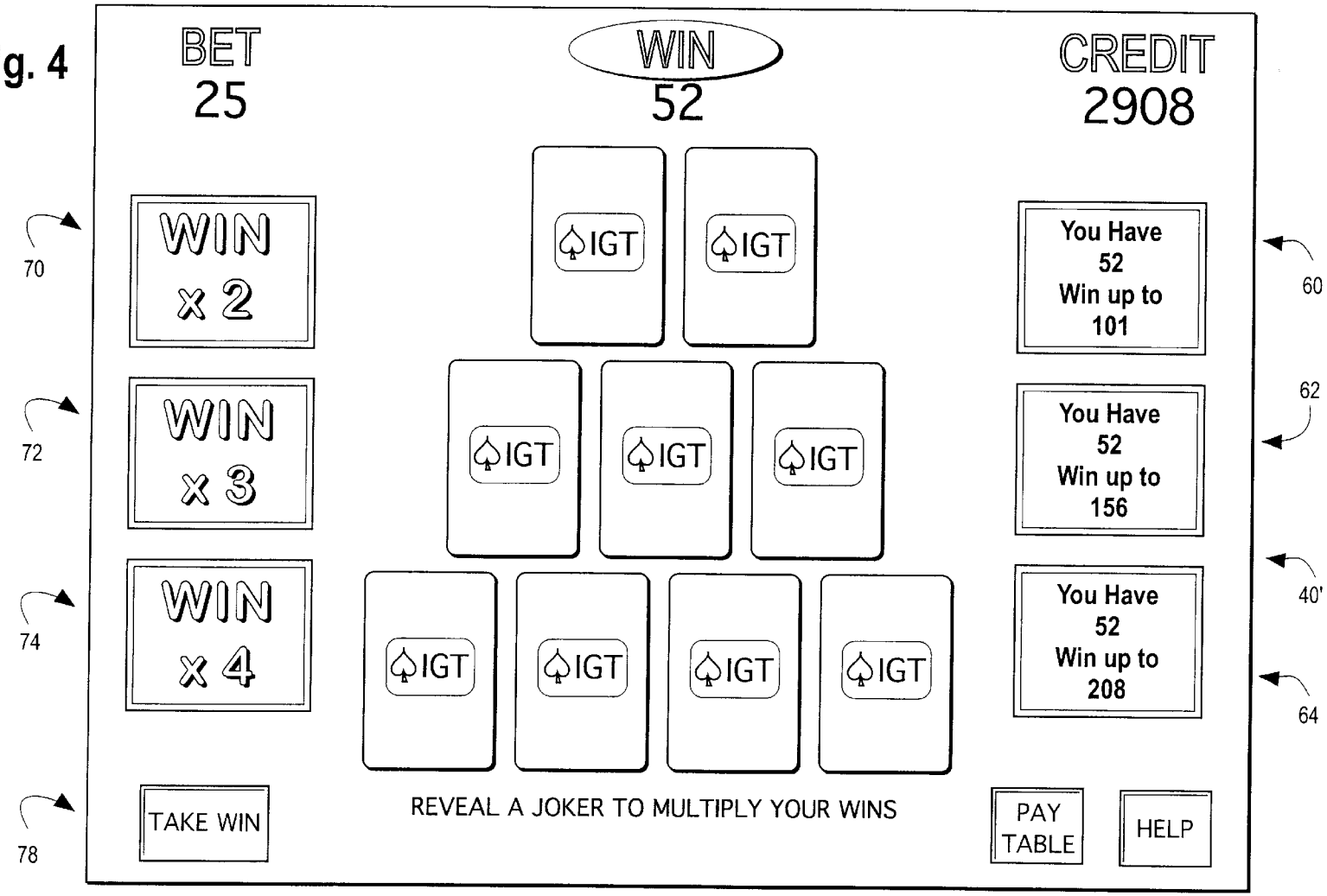
FIG. 4 shows a representative screen display illustrating the bonus game feature.

In this example, the player has won 52 credits in play of the base game (i.e. FIG. 2), and the bonus game feature is now entered such that the display presents the various indicia as shown at FIG. 4. Particularly, there are three rows, respectively of 2, 3 and 4 playing cards arranged face down. As can be noted, according to the illustrated embodiment, the arrangement of the cards is pyramidal, giving an aesthetic feel, linking to the multiple odds possibility available to the player. The three indicia 60, 62, 64 on the right hand side of the display 40', indicate to the player the current winnings available to be wagered in the bonus game feature and the possible winnings. With reference to the indicia 70, 72, 74 shown on the left hand side of the display 40', it can be seen that for the top-most row of two cards there is the prospect of doubling the winnings perfectly balanced odds. For the middle row of three cards there is the prospect of trebling the winnings, and for the bottom-most row of four cards there is the possibility of quadrupling the winnings. There is an integer relationship between winnings for each row.

A further indicia 78 located at the lower left hand comer of the display 40' is a "TAKE WIN" control, by which the player can step out of the game bonus feature and return to the base game. The game bonus feature operates by placing a "Joker" card at one position in each of the three rows. It is then for the player to choose one of the rows, and thus the level of the gamble, then select which card within the row is the "Joker" card. This is done by the player touching the screen to select the card of choice.

Figure 5:
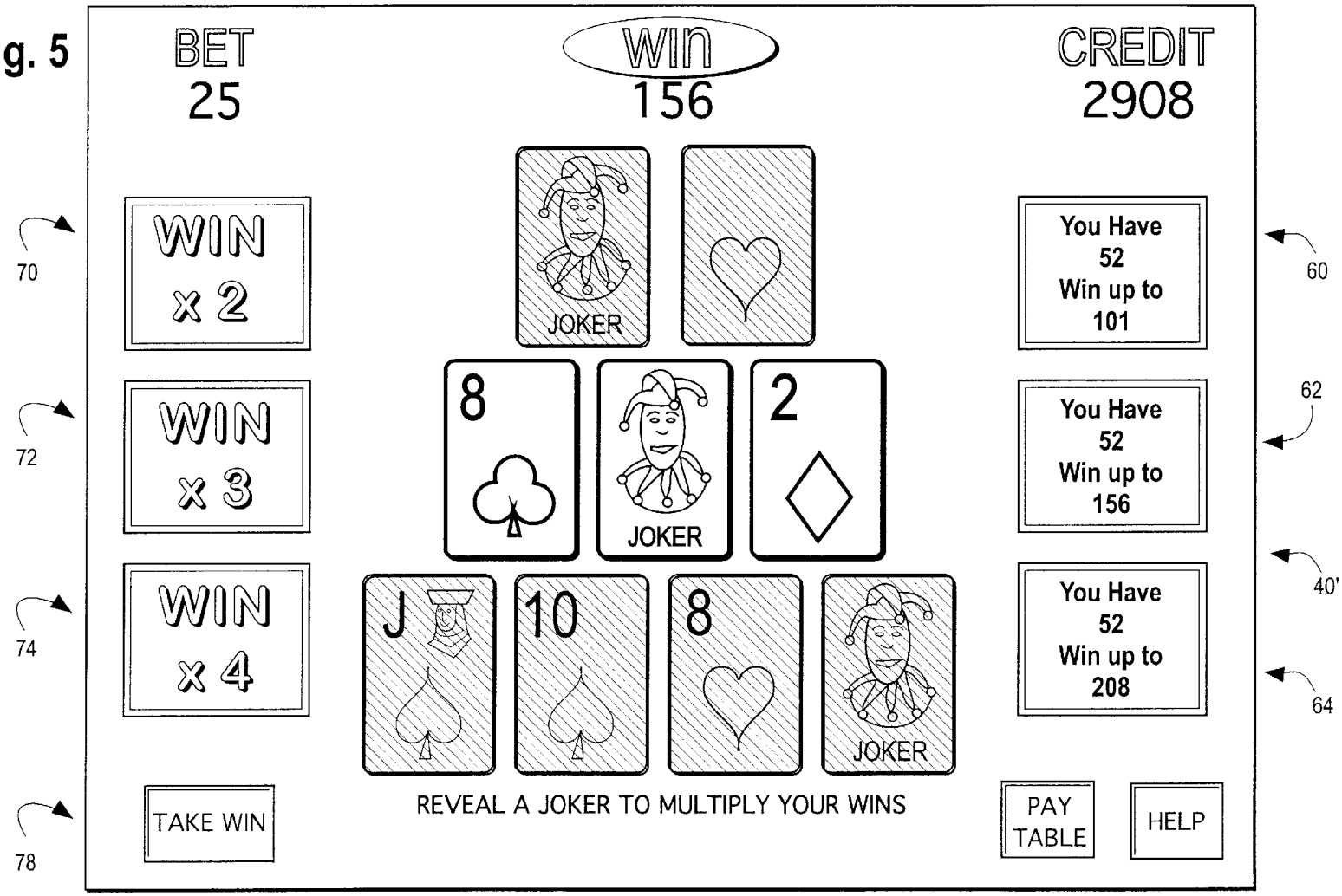
FIG. 5 shows yet another representative screen display illustrating the bonus game feature .

FIG. 5 shows that the player has selected the middle card of the middle row which, as it transpires, was the "Joker" card in that row, in which case the bonus wager has been successful and the player's winnings from the base game have been increased from 52 to 156, as shown in the Win Meter of the display 40'. The display 40' also shows the location of the "Joker" cards in the other two rows, in "greyed-out" form. The player can now either "take the winning" so that the 156 credits will be added to the credit tally, (i.e. 2908+156=3064), or play the bonus game feature again.

As will be apparent to one skilled in the art, the winning "Joker" card can be substituted by any other convenient playing card, for example an Ace of Spades. What is important, however, is that one winning card is present in each of the respective rows. Taking the example of the bottom-most row in FIGS. 4 and 5; there are four cards, of which only one is a win card, meaning that the chances of correctly choosing that card are "1 in 4", which directly relates to the win multiplier of "×4".

Numerous alterations and modifications, as would be apparent to one skilled in the art, are to be considered as incorporated herein.

The present invention, in various embodiments, includes components, methods, processes, systems and/or apparatuses substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein, or in various embodiments hereof, including in the absence of such items as may have been used in previous devices or processes, e.g., for improving performance, achieving ease and/or reducing cost of implementation. The present invention includes items which are novel, in terminology adapted from previous and/or analogous technologies, for convenience in describing novel items or processes, but does not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method for operation of a gaming machine, comprising the steps of:

providing a primary game; and on occurrence of a triggering event in a play of said primary game, entering a bonus game in which a common game type with two or more game choices is provided, said game choices having respective odds of winning that are inversely proportional to the number of possible selections within each game choice and wherein a win of a bonus game results in a prize that is proportional to the number of possible selections within the respective game choice.

2. The method of claim 1, comprising the further step, relating to a chosen said game choice, of a game play choice being made to determine the outcome of said bonus game.

3. The method of claim 2, wherein said game choices are displayed graphically in a manner to indicate the graduation of winning odds.

4. The method of claim 3, comprising the further step of, upon a successful game play choice being made, awarding winnings, wherein said winnings are in the same unique integer multiples as each respective game choice.

5. The method of claim 4, wherein said bonus game is a card game, and said game choices represent dealt hand of cards having an increasing number of cards per hand, and said game play choice is the choice of one card from a chosen hand.

6. The method of claim 5 wherein said primary game is a spinning reel game, and said triggering event is the occurrence of any one of a plurality of predetermined winning combinations.

7. A gaming machine comprising:

a display by which game play is displayed to a player;

player input controls for player interaction in game play; and a programmed controller, having control over game play and operation, and operable to provide a primary game, and on occurrence of a triggering event in play of the primary game to enter a bonus game in which a common game type with two or more game choices is provided, said game choices having respective odds of winning that are inversely proportional to the number of possible selections within each game choice and wherein a win of a bonus game results in a prize that is proportional to the number of possible selections within the respective game choice.

8. The gaming machine of claim 7, wherein for a chosen said game choice, a game play choice, input via the player input controls, determines the outcome of said bonus game.

9. The gaming machine of claim 8, wherein said game choices are displayed on said display graphically in a manner to indicate the graduation of winning odds.

10. The gaming machine of claim 9, wherein said bonus game is a card game, and said game choices are represented on the display as dealt hands of cards having an increasing number of cards per hand, and said game play choice is the choice made by the player input controls of one card from a chosen hand.

11. The gaming machine of claim 10, wherein said controller provides said first game as a spinning reel game displayed on the display, and said triggering event is the occurrence of any one of a plurality of predetermined winning combinations.

12. A method for operation of a gaming machine, comprising the steps of:

providing a spinning reel game of chance; and on occurrence of a triggering event in a play of said spinning reel game, entering a bonus card game including the further steps of:

(i) displaying at least two rows of face-down cards; the number of cards in each of said rows being different;

(ii) a player selecting a row and choosing a card within that row, and wherein the respective odds of choosing a winning card are inversely proportional to the number of cards within that row, and wherein a win of said bonus card game results in a prize that is proportional to the number of cards within that row.

13. The method of claim 12, comprising the further step of awarding winnings upon choice of a winning card, said winnings being in the same unique integer multiples as said rows.

14. The method of claim 13, wherein said rows of cards are graphically arranged in a pyramidal arrangement indicating the graduation of odds.

15. The method of claim 12 wherein there are said three rows, each respectively of two, three and four cards.

16. A method of operating a gaming machine, comprising:

providing a gaming machine that includes:

a processor for executing a base gaming procedure and a bonus gaming procedure;

a display, coupled to said processor; and player pushbuttons;

receiving input from a player to initiate play of a base game;

determining an outcome of said base game, wherein an outcome of said first game comprises at least one of a win and a loss;

displaying said outcome of said base game;

in response to at least one of said outcomes of said base game displaying a plurality of bonus game options as a part of said bonus gaming procedure, each bonus game option having respective odds of winning that are inversely proportional to the number of possible selections within each bonus game option, and wherein a win of a bonus game option results in a prize that is proportional to the number of possible selections within the respective game option;

receiving input from said player selecting play of a one of said bonus game options; and determining an outcome of said bonus game.

17. The method of claim 16, further comprising displaying a plurality of simulated reels on said display as a part of said base gaming procedure, each reel having a plurality of symbols.

18. The method of claim 16 in which said bonus game option has winning and losing outcomes, one of said outcomes being selected by a step comprising the player selecting one of a group of indicia.

19. The method of claim 18 in which said step of displaying a plurality of bonus game options comprises displaying a plurality of playing cards in a plurality of rows, each row having a different number of cards, wherein said step of receiving input from said player comprises selection by the player of one of said plurality of cards in one of said rows, and wherein said method further comprises awarding as a bonus prize a multiple of at least one of an amount wagered and a prize amount if said selected card is a winning card.

20. The method of claim 19 in which each of said rows is associated with a win probability wherein said player may select a single card in any one of said rows, and wherein said multiple of an amount wagered is determined by said win probability of said row to which said selected card belongs.

21. A method of operating a gaming machine, comprising:

providing a gaming machine that includes:

a processor for executing a base gaming procedure and a bonus gaming procedure;

a display, coupled to said processor; and player pushbuttons;

receiving input from a player to initiate play of a base game;

determining an outcome of said base game, wherein an outcome of said first game comprises at least one of a win and a loss;

displaying said outcome of said base game;

in response to at least a one of said outcomes of said base game, displaying a plurality of bonus game options as part of said bonus gaming procedure, wherein each of said options provides said player with a different probability of a win;

in which the step of displaying the plurality of bonus game options comprises displaying a plurality of playing cards, wherein said step of receiving input from said player comprises receiving input from a user selecting one of said plurality of cards, and wherein said method further comprises awarding as a bonus prize a multiple of at least one of an amount wagered and a prize amount if said selected card is a winning card, in which said plurality of playing cards are arranged in a plurality of rows, wherein each of said rows has associated with it a win probability wherein said player may select a single card in any one of said rows, and wherein said multiple of an amount wagered is determined by said win probability of said row to which said selected card belongs, and further in which said plurality of rows is arranged in a pyramidal fashion, wherein a first of said rows comprises two cards, and the last of said rows comprises more than two cards.

22. The method of claim 21 in which the multiple of an amount wagered is equal to the number of cards present in the row from which a card is selected by the player.

23. The method of claim 16 in which said display is a touch sensitive display, and in which said player push buttons comprise buttons displayed on said touch sensitive display.

24. The method of claim 1 in which the game choice chosen by the player has an outcome that is also chosen by the player selecting one indicium from a group of indicia.

25. The gaming machine of claim 7 in which the game choice chosen by the player has a group of indicia from which one indicium is selected by the player of the bonus game.

* * * * *

UNITED STATES PATENT AND TRADEMARK OFFICE

CERTIFICATE OF CORRECTION

PATENT NO. : 6,450,883 B1
DATED : November 7, 2002
INVENTOR(S) : O'Halloran

It is certified that error appears in the above-identified patent and that said Letters Patent is hereby corrected as shown below:

Title page,
Item [56], References Cited, U.S. PATENT DOCUMENTS, add
-- 6,334,814 A * 1/2002 Adams… 463/20 --.

Column 4,
Lines 65 and 66, cancel "in the same unique integer multiples as" and replace with
-- n times for --.

Signed and Sealed this

Eighteenth Day of February, 2003

JAMES E. ROGAN
*Director of the United States Patent and Trademark Office*